US006305386B1

(12) United States Patent
Wochadlo

(10) Patent No.: US 6,305,386 B1
(45) Date of Patent: Oct. 23, 2001

(54) HAIR DECORATION

(75) Inventor: Linda Cathrin Wochadlo, Chichago, IL (US)

(73) Assignee: Claire's Boutiques, Inc., Hoffman Estates, IL (US)

( * ) Notice: Subject to any disclaimer, the term of this patent is extended or adjusted under 35 U.S.C. 154(b) by 0 days.

(21) Appl. No.: 09/440,739

(22) Filed: Nov. 16, 1999

(51) Int. Cl.[7] ..... A45D 8/40; A45D 8/04
(52) U.S. Cl. ..... 132/275; 132/273; D28/41
(58) Field of Search ..... 132/275, 273, 132/200; D28/41, 39; 2/171

(56) References Cited

U.S. PATENT DOCUMENTS

| | | | | |
|---|---|---|---|---|
| D. 163,934 | | 7/1951 | Chernow | D45/16 |
| D. 229,268 | | 11/1973 | Levine | D6/205 |
| D. 232,207 | | 7/1974 | Levine | D6/205 |
| D. 232,683 | | 9/1974 | Levine | D6/205 |
| D. 246,293 | | 11/1977 | Doughty | D11/4 |
| D. 261,181 | | 10/1981 | Sands | D28/32 |
| D. 300,881 | | 5/1989 | Dickenson | D2/170 |
| D. 317,663 | | 6/1991 | Calderon | D28/41 |
| D. 347,493 | | 5/1994 | Connolly | D28/41 |
| D. 395,100 | | 6/1998 | Nahoum | D28/41 |
| 3,190,086 | | 6/1965 | Klein | 66/193 |
| 4,178,879 | * | 12/1979 | Cunningham | 119/106 |
| 4,406,296 | | 9/1983 | Wexler et al. | 132/148 |
| 4,858,425 | | 8/1989 | Cheredaryk et al. | 59/80 |
| 5,388,598 | * | 2/1995 | Whitten | 132/275 |
| 5,404,892 | * | 4/1995 | Bretl | 132/200 |
| 5,499,638 | | 3/1996 | Ripley | 132/273 |
| 5,626,503 | * | 5/1997 | Heftel et al. | 446/73 |
| 5,713,080 | | 2/1998 | Tate | 2/244 |
| 5,771,908 | | 6/1998 | Dorsey | 132/275 |
| 5,775,345 | | 7/1998 | Chou | 132/278 |
| 5,778,904 | * | 7/1998 | Elsner | 132/275 |
| 5,794,459 | | 8/1998 | Ignatowski | 63/38 |
| 5,881,736 | * | 3/1999 | Turner et al. | 132/200 |
| 5,890,498 | * | 4/1999 | Kawaguchi | 132/275 |
| 5,926,848 | * | 7/1999 | Bartholomae | 2/171 |
| 5,934,294 | | 8/1999 | Chiang | 132/275 |
| 5,946,728 | | 9/1999 | Tane | 2/171 |
| 6,009,882 | * | 1/2000 | Schine et al. | 132/200 |
| 6,024,102 | * | 2/2000 | Huang | 132/273 |
| 6,105,586 | * | 8/2000 | Hebenstreit | 132/278 |

FOREIGN PATENT DOCUMENTS

| | | | |
|---|---|---|---|
| 0 819 392 A1 | 1/1998 | (EP) | A45D/8/34 |
| 10057138 | 3/1998 | (JP) | A45D/8/00 |
| 10057138 A | 3/1998 | (JP) . | |

* cited by examiner

*Primary Examiner*—John J. Wilson
*Assistant Examiner*—Robyn Kieu Doan
(74) *Attorney, Agent, or Firm*—David Wolf, Esq.

(57) ABSTRACT

A hair decoration including a hair engaging member, such as a clip or barrette, a plurality of elongated flexible members, such as ribbon or monofilament, extending lengthwise from and each secured to the hair engaging member, and a plurality of discrete decorative elements, such as beads, stones, gemstones, beads, miniatures, and miniature cartoon characters, figurines, letters, flowers, birds, insects and animals.

3 Claims, 1 Drawing Sheet

HAIR DECORATION

FIELD OF THE INVENTION

The invention relates to a hair decoration and, in particular, to a new and improved decoration for use in decorating hair braids and other hair styles.

RELATED ART

Ribbons, elastics and hair clips are widely used in hair styling both as hair decorations and to restrain and manage hair. However, ribbons, elastics and hair clips typically are used in a limited number to restrain or manage the wearer's hair. It is rare to use many of them to fully decorate the hair. Some hair or head decorations such as head bands or tiaras provide more decoration than ribbon and hair clips, but are cumbersome and limit the choice of hairstyles. Furthermore, the use of such decorations is no longer stylish and many no longer accent and draw attention to the wearer as desired. Accordingly, there is a need for hair decorations which are capable of decorating large portions of the wearer's hair without encumbering the wearer or limiting the wearer's choice of hairstyles, and which are new and eye catching.

SUMMARY OF THE INVENTION

The invention is directed to a hair decoration including a hair engaging member having portions thereof for securing the decoration to the wearer's hair, a plurality of elongated flexible members extending lengthwise from and each secured at one end to the hair engaging member, and a plurality of discrete decorative elements secured along the length of the elongated members in spaced relation to one another. In one embodiment, the elongated flexible members each comprise a flexible monofilament. In another embodiment, the decorative elements include a selection from a group consisting of stones, gemstones, beads, miniatures, and miniature cartoon characters, figurines, letters, flowers, birds, insects and animals. These elements are discrete ornamentations designed to be positioned on the wearer's head at random locations. In a further embodiment, the monofilament has spaced knots securing the decorative elements. In yet another embodiment, the decorative elements are adhered to the monofilament. In one embodiment, the elongated flexible members each comprise a flexible fabric ribbon. In a further embodiment, the ribbon has spaced knots securing the decorative elements. In yet another embodiment, the decorative elements are adhered to the ribbon. In one embodiment, the elongated flexible members each comprise a flexible decorative cord. In a further embodiment, the decorative cord has spaced knots securing the decorative elements. In yet another embodiment, the decorative elements are adhered to the decorative cord.

DETAILED DESCRIPTION

Figure 1:
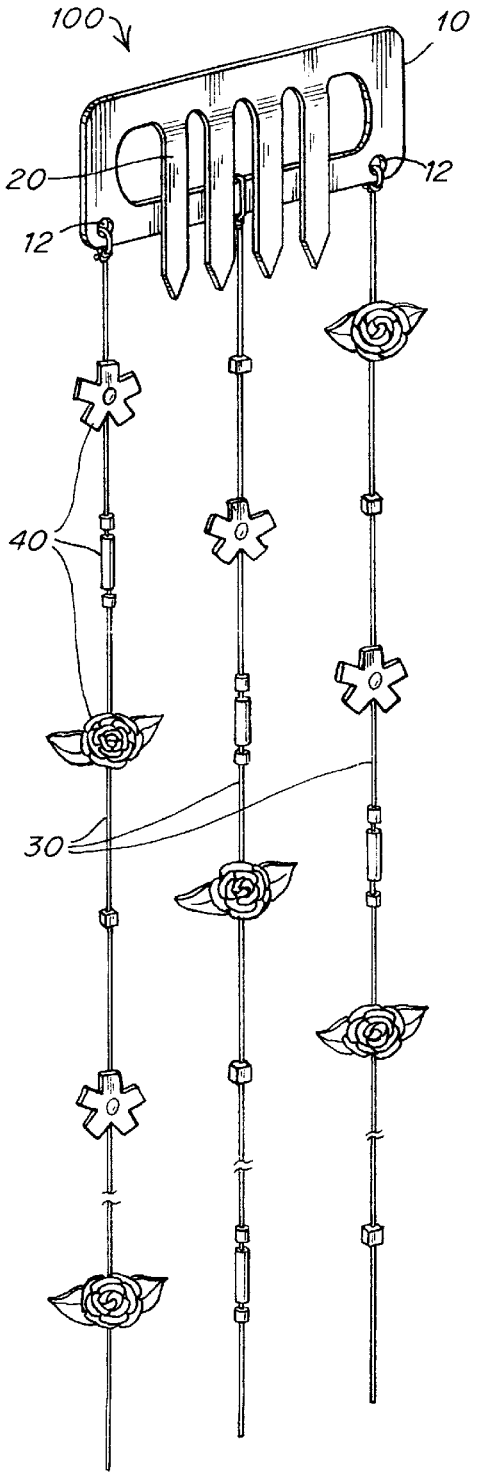
FIG. 1 is a front view of one embodiment.

A hair decoration 100 is illustrated in FIG. 1. The decoration 100 includes a comb-like hair engaging member 10 including a portion 20 for securing the decoration to the wearer's hair. The hair decoration also includes elongated flexible members 30 and discrete decorative elements 40 secured along the length of the elongated members in spaced relation to one another.

Figure 2:
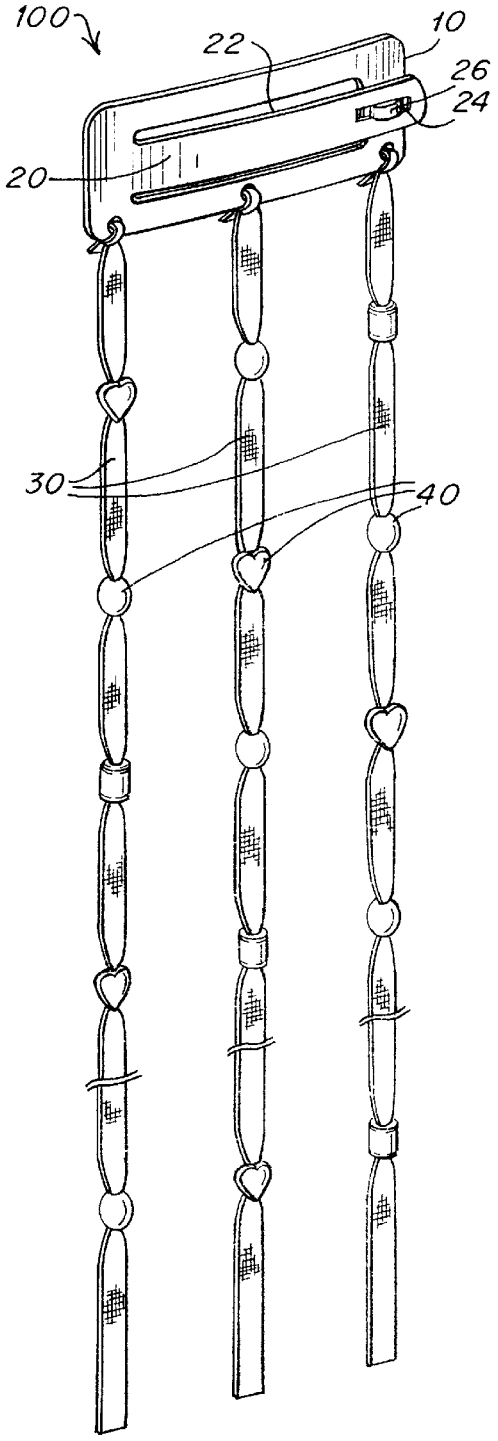
FIG. 2 is a front view of another embodiment.

The hair engaging member 10 may be of any construction which will allow the hair decoration to be secured to the wearer's hair while not interfering with the styling of the hair or encumbering the wearer. For example, as illustrated in FIG. 1, the hair engaging member 10 may be a clip having a portion 20 for securing the decoration comprising a plurality of teeth which may be selectively engaged or disengaged from the wearer's hair by bending the clip. FIG. 2 illustrates a second example in which the hair engaging member 10 is a barrette or hair clip. The barrette or hair clip 10 has a portion 20 for securing the decoration consisting of a flexible member 22 attached to the body of the barrette or hair clip 10 at one end and having a hole 24 on the other end which may be engaged to a protrusion 26 on the body of the barrette or hair clip, securing the hair decoration 100 to the wearer's hair.

The hair engaging member 10 may be constructed of any material which is sufficiently sturdy to withstand frequent use while being sufficiently flexible to allow the hair engaging member to be secured and released from the wearer's hair. For example, the hair engaging member 10 may be formed of plastic. Preferably, the hair engaging member 10 is constructed of metal. The hair engaging member should have an attractive design as it partially functions as a hair ornamentation.

The hair engaging member is preferably constructed to facilitate the attachment of elongated members 30, for example by tying them to hair engaging member 10. For example, as illustrated in FIG. 1, the hair engaging member 10 may include holes 12 for attaching the elongated members. Alternatively, the members 30 may be attached with an adhesive to the hair engaging member 10.

The elongated flexible members may be constructed of any material which is relatively light weight and sufficiently flexible to be styled with the wearer's hair. Preferably, the elongated members are constructed of a material which facilitates attachment of the discrete decorative elements 40. Also, the elongated flexible members are preferably constructed of a strong, durable material which is capable of withstanding repeated bending. In one preferred embodiment, the elongated members 30 are transparent or blend with wearer's hair such that the decorative elements 40 appear to be independently located in the hair. For example, the elongated members 30 may be constructed of transparent or translucent monofilament as illustrated in FIG. 1. Such monofilament are typically used as fishlines. Preferably, this monofilament has at least a 101b test strength. As additional examples, the elongated flexible members may also be constructed of decorative cord or flexible fabric ribbon, as illustrated in FIG. 2. Elongated flexible members 30 constructed of differing materials may also be combined in a single hair decoration.

As illustrated in FIG. 1, in a preferred embodiment, three elongated flexible members are each secured at one end to the hair engaging member 10. Other numbers of elongated flexible members 30 may be preferable depending on the hair and hair style of the wearer. The length of the elongated flexible members 40 is preferably uniform, though this may vary depending on the hairstyle. The flexible members 40 are preferred to be 12 in. in length, though this may also vary with the hairstyle, as, for example, from 4" to 18".

The discrete decorative elements 40 may comprise anything which will decorate the wearer's hair and draw attention to the wearer. The decorative elements 40 should be large enough to be noticeable but small enough to neither encumber the wearer nor to inhibit the appearance that they are independently attached to the wearer's hair. The decorative elements 40 may be selected to cater to many styles, tastes and ages of wearer. For example, the decorative elements 40 may include stones, gemstones, beads, miniatures, and miniature cartoon characters, figurines, letters, flowers, birds, insects and animals. They may be used on a variety of materials such as metal, stone, wood, or plastic, and maybe formed in a variety of colors. Mixtures of decorative elements 40 either on different elongated members 30, or on the same member, may create particularly striking effects.

The method of attaching decorative elements 40 may vary with the type of elongated flexible member 30. For example, in applications where the elongated flexible member 30 is monofilament the discrete decorative elements 40 may be fixed to the elongated flexible member by tying them at discrete intervals along the member. This method of attachment may also be suitable for decorative cord and thin ribbons. For wider ribbons and other elongated flexible members, other methods of attachment may be preferred. For example, the discrete decorative element 40 may be glued to the elongated flexible member 30.

The hair decoration 100 illustrated in FIG. 1 may be used in many hair styling applications for many lengths and types of hair. For example, the hair decoration 100 may be attached via the hair engaging member 10 at the base of hair which is to be braided and the elongated flexible members 30 may be intertwined with the hair as it is braided such that the discrete decorative elements 40 decorate the braid. The hair decoration 100 may also be used in conjunction with other hair styles. For example, the elongated flexible members 30 may be intertwined into the hair as it is placed in a bun, or twisted around portions of hair. The hair decoration 100 may also be secured to the wearer's hair via hair engaging member 10 and the elongated flexible members 30 may freely move within the wearer's hair allowing the discrete decorative elements 40 to provide variable decoration to the wearer's hair.

What is claimed is:

1. A hair decoration comprising:

a hair engaging member having portions thereof for securing the decoration to a wearer's hair;

a plurality of elongated flexible members each comprising a flexible monofilament having at least a 10 pound (lb.) test strength extending lengthwise from and each secured at one end to the hair engaging member; and a plurality of discrete decorative elements secured along the length of the elongated members in spaced relation to one another.

2. A hair decoration comprising:

a hair engaging member having portions thereof for securing the decoration to a wearer's hair;

a plurality of elongated flexible members each comprising a translucent flexible monofilament having at least a 10 pound (lb.) test strength extending lengthwise from and each secured at one end to the hair engaging member; and a plurality of discrete decorative elements secured along the length of the elongated members in spaced relation to one another.

3. A hair decoration comprising:

a hair engaging member having portions thereof for securing the decoration to a wearer's hair;

a plurality of elongated flexible members each comprising a transparent monofilament having at least a 10 pound (lb.) test strength extending lengthwise from and each secured at one end to the hair engaging member; and a plurality of discrete decorative elements secured along the length of the elongated members in spaced relation to one another.

* * * * *